United States Patent [19]

Thornhill et al.

[11] 3,981,433

[45] Sept. 21, 1976

[54] ONE-STEP EASY-OPEN CONTAINER FOR REFRIGERATED DOUGH PRODUCTS AND THE LIKE

[75] Inventors: Dewey B. Thornhill, St. Louis, Mo.; Ralph E. Frank, Jr., New Albany, Ind.

[73] Assignee: Boise Cascade Corporation, Boise, Idaho

[22] Filed: Sept. 15, 1975

[21] Appl. No.: 613,201

[52] U.S. Cl. ..... 229/51 BP; 229/4.5; 229/21; 426/128

[51] Int. Cl.[2] ..... B65D 3/26; B65D 85/36

[58] Field of Search ..... 229/51 BP, 4.5, 21; 426/122, 123, 128

[56] References Cited

UNITED STATES PATENTS

| | | | |
|---|---|---|---|
| 2,681,284 | 6/1954 | Graves | 229/51 BP |
| 3,221,975 | 12/1965 | Zoeller et al. | 229/51 BP |
| 3,241,739 | 3/1966 | Ahlemeyer | 229/51 BP |
| 3,304,185 | 2/1967 | Fortney | 229/51 BP |
| 3,441,197 | 4/1969 | White | 229/51 BP |
| 3,724,742 | 4/1973 | Henderson | 229/51 BP |

*Primary Examiner*—William Price
*Assistant Examiner*—Bruce H. Bernstein
*Attorney, Agent, or Firm*—Lawrence E. Laubscher

[57] ABSTRACT

An easy-open composite container is disclosed having an unbonded helical butt joint that extends the length of the container, characterized by the provision of an impervious inner liner layer having a helical folded portion which is coextensive with and extends the length of the unbonded butt joint. A peelable outer reinforcing or wrapper layer bonded to the outer surface of the fibrous body wall layer normally holds the edges of the butt joint together. Upon removal of the outer reinforcing layer, the ends of the container may be twisted in opposite directions to open the unbonded butt joint and to expand and rupture the inner liner layer folded portion. In the case where products under pressure, such as refrigerated dough products, are packaged in the container, upon removal of the outer reinforcing layer, the products expand to automatically open the butt joint and to expand and rupture the inner liner folded portion. If desired, the folded inner liner portion may have a creased fold line that defines a line of weakness, and/or the folded portion may be adhered to the corresponding inner surface by an adhesive having a relatively low coefficient of adhesion.

9 Claims, 8 Drawing Figures

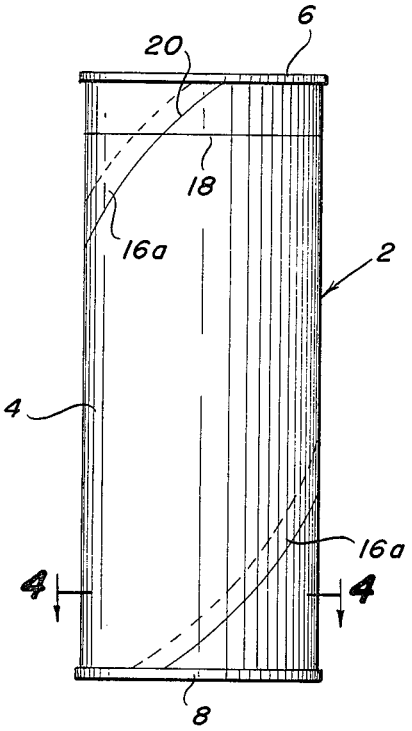
Fig. 1
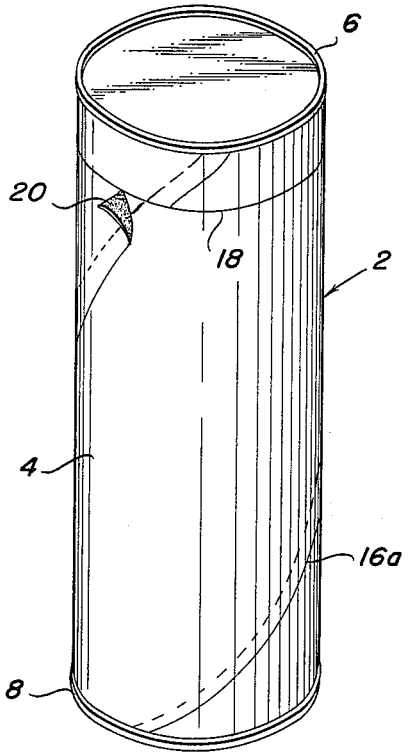
Fig. 2
Fig. 3
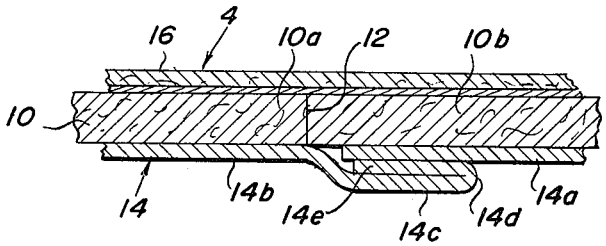
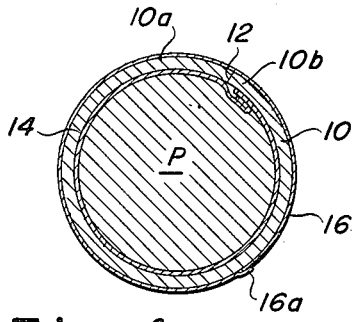
Fig. 4
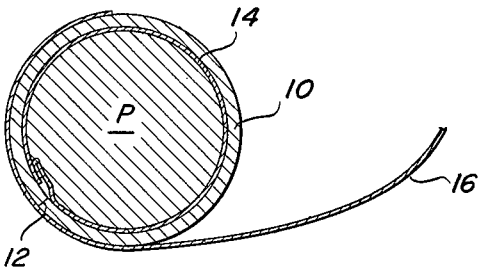
Fig. 5

ONE-STEP EASY-OPEN CONTAINER FOR REFRIGERATED DOUGH PRODUCTS AND THE LIKE

BRIEF DESCRIPTION OF THE PRIOR ART

As evidenced by the prior U.S. patents to Fienup et al. U.S. Pat. Nos. 2,793,126, 2,975,068, and 3,712,534, Geist et al. U.S. Pat. No. 2,793,127 and Henderson U.S. Pat. No. 3,724,742, among others, it is well known in the patented prior art to provide composite containers for products under pressure — such as refrigerated preleavened dough products — which containers include tubular laminated body walls formed of layers of paper or paperboard, metal foil, synthetic plastic material or the like, and metal end closure members closing the ends of the tubular body walls.

In many of these known types of composite containers, it is conventional to provide body walls having a helical butt joint that extends the length of the container, an impervious inner liner layer of foil or the like which isolates the moisture of the packaged product from the fibrous body wall layer, and a peelable outer wrapper or label layer which surrounds and reinforces the fibrous body wall layer. Normally, to open these known types of containers, it is necessary to remove completely the outer wrapper from the fibrous body wall layer, whereupon the container is rapped with appreciable force against a sharp surface, such as a table edge, to rupture the helical butt joint and the inner liner layer, whereupon the ends of the container are twisted to open the butt joint for removal of the packaged product from the container.

One drawback of these known devices is that they often fail to open properly, primarily owing to the failure of the user to accurately strike the container — with adequate force or at a proper location relative to the helical butt joint — against the stationary object.

SUMMARY OF THE INVENTION

The present invention was developed to avoid the above and other drawbacks of the known composite containers and to provide an easy-open container for packaging products both under pressure and not under pressure. In the case where the packaged products are under pressure, such as refrigerated dough products, the container is automatically opened in a one-step manner by the removal of an outer reinforcing wrapper layer. In the case where the container contains products which are not packaged under pressure, the outer reinforcing wrapper layer is removed, whereupon the ends of the container are twisted in opposite directions to open the unbonded butt joint and to rupture the impervious inner liner layer.

Accordingly, the primary object of the present invention is to provide an easy-open container including a helically-wound fibrous body wall layer containing an unbonded helical butt joint that extends the length thereof, an impervious inner liner layer having a helically-extending folded portion that is coextensive with and straddles the butt joint throughout the length of the container, and a peelable outer wrapper or label layer which is secured to the outer surface of the fibrous body wall layer to hold together the edge portions of the butt joint. Preferably the folded inner liner portion includes a creased fold line that defines a line of weakness which extends the length of the butt joint. If desired, the folded portion may be adhesively secured to the inner surface of the other edge of the inner liner layer on the opposite side of the butt joint by a low coefficient of adhesion relative to the shear strength of the inner liner layer. In the case where products under pressure (such as refrigerated dough products) are packaged in the container, when the outer reinforcing layer is removed, the packaged product expands to open the unbonded butt joint and to expand the folded inner liner portion to rupture the same. In the case where the packaged products are not under pressure, the container is opened by removing the outer reinforcing layer and by twisting the ends of the container in opposite directions, thereby to open the unbonded butt joint and to expand and rupture the folded liner portion.

According to a further object of the invention, the peelable outer wrapper reinforcing layer is bonded at least to those edge portions of the outer surface of the fibrous body layer arranged on opposite sides of the butt joint. If desired, the outer wrapper layer may be bonded to the entire outer surface of the fibrous body wall layer. In order to assist in the peeling off of the outer wrapper layer, it may be provided with an overlapping trailing edge and contain a circular scoreline spaced a slight distance from one end of the container to define a triangular pull tab portion. While normally the outer wrapper layer is helically-wound in an edge-overlapped manner on the container in bridging relation across the helical joint, the outer wrapper layer could be concentrically wound in a cylindrical manner about the container. Furthermore, in accordance with another embodiment of the invention, the outer reinforcing layer may comprise a peelable continuous relatively narrow helical strip that is coextensive with and bridges the butt joint throughout the length thereof, said strip being secured to the outer surfaces of the edge portions of the fibrous body wall layer on opposite sides of the butt joint, thereby to maintain the butt joint edges together.

BRIEF DESCRIPTION OF THE DRAWING

Other objects and advantages of the present invention will become apparent from a study of the following specification when viewed in conjunction with the accompanying drawing, in which:

FIG. 1 is a side elevation view of a composite container embodying the one-step easy-open feature of the present invention;

FIG. 2 is a perspective view of the container of FIG. 1, illustrating the first step taken in removing the outer wrapper layer to open the container;

FIG. 3 is a detailed sectional view of a portion of the container illustrating the arrangement of the cylindrical body wall member with helical butt joint, the inner liner layer with folded edge portion and the outer wrapper layer;

FIG. 4 is a sectional view taken along line 4—4 of the container of FIG. 1;

FIG. 5 is a view similar to FIG. 4, showing the label layer partially pulled away from its adhesive connection with the body wall;

DETAILED DESCRIPTION

Figure 6:
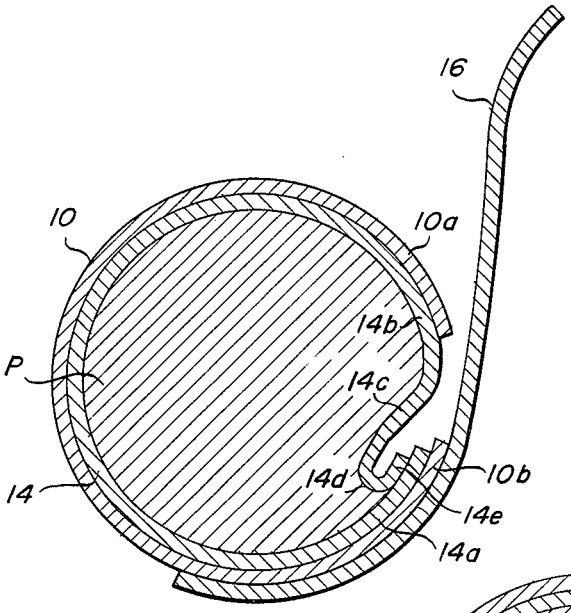
FIG. 6 is a view similar to FIG. 5, showing the label layer pulled away from the body wall to a point past the butt joint, illustrating the separation thereof.

Referring first more particularly to FIGS. 1–4, the composite container 2 of the present invention includes a tubular composite body wall 4 and a pair of metal end closure members 6 and 8 for packaging products either under pressure (for example, refrigerated dough products) or not under pressure.

As shown in FIG. 3, the tubular body wall 4 includes a helically-wound fibrous body wall layer 10, formed of paper or paperboard, for example, having unbonded abutting edge portions 10*a* and 10*b* that define a helical butt joint 12 which extends the length of the container. Secured to the inner surface of the body wall layer 10 is a helically-wound impervious inner liner layer 14 having a trailing edge portion 14*a*, and a leading edge portion 14*b* having an extension 14*c* which bridges the butt joint and is reversely folded back upon itself about creased fold line 14*d* to define an inner flap portion 14*e* that is bonded to the inner surface of the trailing inner liner edge portion 14*a*, thereby to bridge the unbonded butt joint. The inner liner layer is formed from an impervious material (such as aluminum foil, a synthetic plastic material such as polyethylene, a paperfoil laminate, or the like) for isolating the moisture of the packaged product from the fibrous layer. In the illustrated embodiment, the inner liner portions 14*a* and 14*b* are adhesively bonded to the inner surface of the fibrous body wall layer 10 by means of a suitable adhesive (such as a polyvinyl alcohol adhesive).

Adhesively secured to the outer surface of the body wall layer 10 is a peelable helically-wound outer wrapper layer 16 which bridges the outer surface of the butt joint 12 and holds together the adjacent edge portions 10*a* and 10*b* of the body layer 10. The peelable outer wrapper layer, which may comprise a label layer bearing printed indicia, is formed of a suitable material such as paper, metal foil, or a suitable synthetic plastic material, such as polyethylene. The outer wrapper layer is adhesively secured to the outer surface of the fibrous body wall layer 10 by means of a suitable adhesive (such as a polyvinyl alcohol adhesive).

Adjacent at least one end of the container, the helically wound outer layer 16 contains a circular scoreline 18 adjacent and spaced from the metal end closure member 6 to define in the overlapping edge portion 16*a* of the outer wrapper a triangular pull tab portion 20 for initiating the peeling of the outer wrapper layer from the container. Upon continued pulling of the pull tab portion 20 relative to the container, the outer wrapper layer is progressively peeled off the outer surface of the fibrous body wall layer as shown in FIG. 4.

Figure 7:
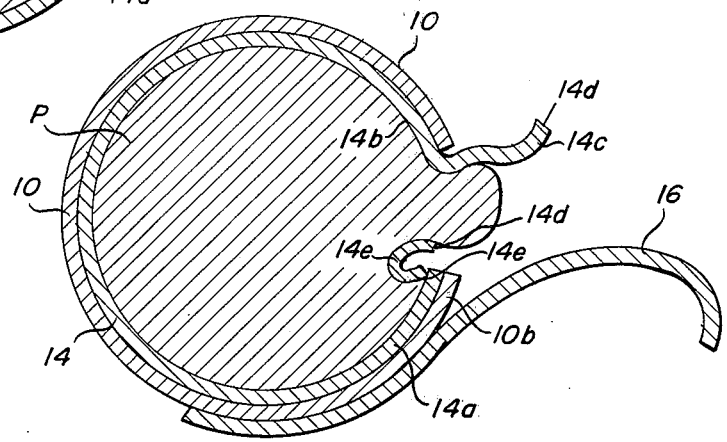
FIGS. 7 and 8 are sectional and perspective views, respectively, illustrating the container in an opened condition with outer wrapper layer partially removed and the inner liner layer in a ruptured condition.
Figure 8:
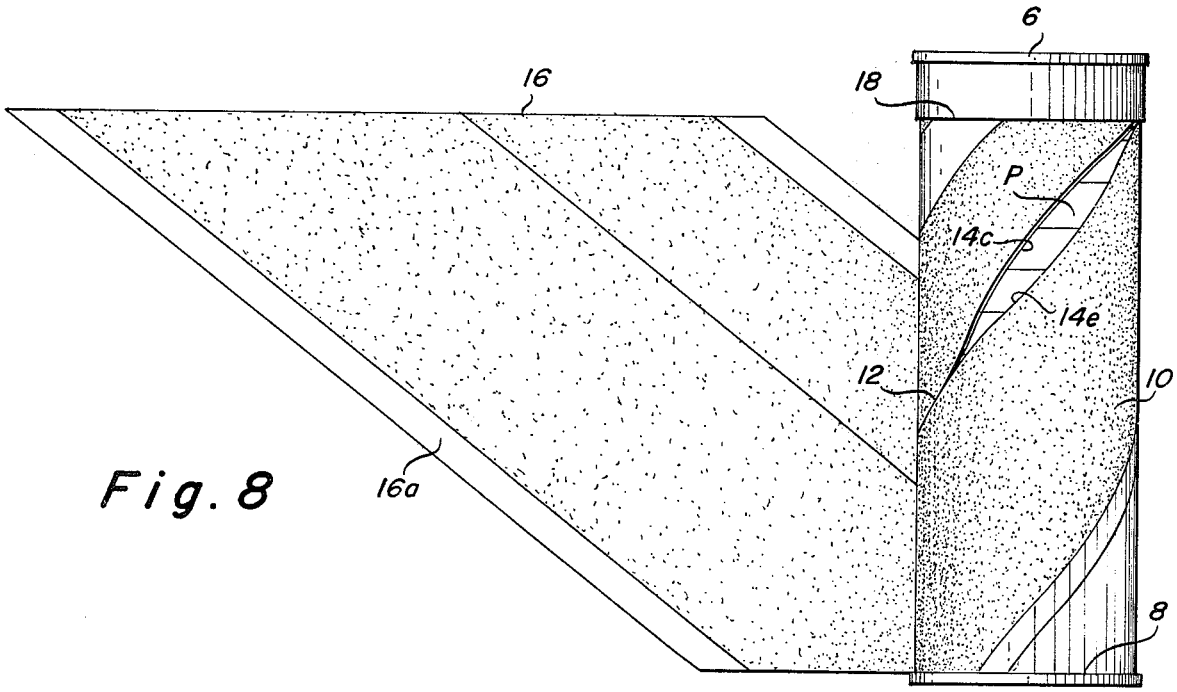

Assuming that the container contains a refrigerated dough product P under pressure (such as preleavened biscuit dough), when the wrapper is peeled from the butt joint edge portion 10*a*, the pressurized packaged product P expands to separate the edges 10*a* and 10*b* of the butt joint 12 and to expand the folded inner liner layer portion to separate the first and second portions 14*c* and 14*e* as shown in FIG. 6, and upon further expansion of the pressurized product, the inner liner layer 14 is either ruptured (for example, along the creased line of weakness 14*d* as shown in FIGS. 7 and 8), or the folded portion is torn away from the liner edge portion 14*a*. Upon removal of the outer wrapper layer 16, the ends 6 and 8 (FIG. 8) of the container may be twisted relative to each other to further open the butt joint to permit removal of the packaged product (which, in the illustrated embodiment, comprises preleavened refrigerated dough in the form of separable biscuits) from the container.

In the event that the container contains a product which is not packaged under pressure, the outer wrapper layer is removed and the end closure members 6 and 8 are twisted in opposite directions to open the butt joint, and to expand the folded inner liner portion to rupture the same.

In one reduction of the invention to practice, the fibrous body layer 10 consisted of 0.026 inch wet strength news lined Kraft cylinder board, 4 inches wide, the inner liner layer 14 consisted of 0.00035 inch heat-sealable polyvinyl lacquer-coated aluminum foil laminated to 25 No. machine glazed wet strength Kraft backing, 4⅜ inches wide, and the label layer 16, which was adhesively secured to the outer surface of the fibrous body wall layer 10 by a polyvinyl alcohol adhesive, consisted of 0.0003 inch aluminum foil laminated to 40 No. machine glazed wet strength Kraft backing, 4⅛ inches wide.

In an alternate embodiment of the invention, the folded inner liner flap portion 14*e* may be adhesively secured to the inner liner trailing edge portion 14*a* by means of an adhesive (such as a polyvinyl alcohol adhesive) having a low coefficient of adhesion relative to the shear strength of the inner liner, the remaining portion of the inner liner layer being adhesively secured to the inner surface of the fibrous body wall layer. In this embodiment, when the outer reinforcing wrapper layer 16 is removed from the butt joint, the butt joint is automatically expanded by the pressurized packaged product to tear the flap portion 14*e* from the inner liner edge portion 14*a*, thereby to open the container along the helical butt joint.

In a further modification of the invention, the outer reinforcing layer may comprise a relatively narrow peelable helical strip that is coextensive with and bridges the butt joint and is adhesively secured to the outer surfaces of the fibrous body layer on both sides of the butt joint by an adhesive having a relatively low coefficient of adhesion. If desired, various types of printed labels can then be applied to the outer surface of the tubular body portion of the container.

It is apparent that, if desired, the trailing edge 14*a* may be spaced slightly from the butt joint 12 to define on the inner surface of the fibrous body wall edge portion 10*b* an uncovered surface to which all or a portion of flap 14*e* is adhesively secured (for example, by an adhesive having a relatively low coefficient of adhesion).

Various other changes and modifications may be made in the diclosed invention without deviating from the inventive concepts set forth above.

What is claimed is:

1. A cylindrical easy-open container consisting solely of:

a. a helically-wound cylindrical body wall layer (10) formed of fibrous material having a helical butt joint extending continuously the length thereof, the adjacent edge portions (10*a*, 10*b*) of said body wall layer defining said butt joint being contiguous and unbonded;

b. a correspondingly helically-wound impervious liner layer (14) secured to and coextensive with the inner surface of said cylindrical body wall layer to bridge the butt joint, one edge portion (14*a*) of said liner layer terminating adjacent and short of a first side of said butt joint, the other edge portion (14*b*) of said liner having a first portion (14*c*) which extends from the other side of said butt joint across and beyond said butt joint, and a reversely folded second portion (14*e*) which extends between said one edge portion (14*a*) and said first portion (14*c*) back toward, and terminates short of, said butt joint, the length of said second portion (14*e*) extending substantially the length of said first portion (14*c*) and terminating adjacent the edge of said one edge portion (14*a*), the fold line (14*d*) between said first and second portions extending helically the length of the container, the outer surface of said reversely folded second liner portion being secured, at least adjacent the free edge extremity thereof, to the inner surface of said liner layer one edge portion to permit relative expansion of said first and second liner portions;

c. a removable outer layer (16) extending across the outer surface of said butt joint and secured to the outer surfaces of the abutting edge portions of said body wall layer substantially throughout the length of said butt joint, thereby to maintain together the body wall edge portions defining said unbonded butt joint; and d. end closure means (6, 8) for closing the ends of said body wall layer, said outer layer being removable from said body wall layer to permit opening of the butt joint and expansion of the liner layer to cause separation of the first and second portions thereof, thereby to automatically open said liner layer along a helical path.

2. An easy-open container as defined in claim 1, wherein said fold line is creased throughout its length to define a line of weakness that is ruptured when the outer reinforcing layer is removed and the butt joint and the folded inner liner portion are expanded.

3. An easy-open container as defined in claim 1, wherein said inner liner layer comprises a layer of metal foil.

4. An easy-open container as defined in claim 3, wherein said inner liner layer is laminated and includes a layer of paper intermediate the metal foil layer and said fibrous body wall layer.

5. An easy-open container as defined in claim 1, wherein said inner liner folded flap portion is adhesively secured to said container inner surface by means of an adhesive having a low coefficient of adhesion relative to the rupture strength of the folded inner liner portion, whereby upon removal of the outer layer, the butt joint may be opened and said inner liner folded flap portion separated from said container inner surface to permit access to the packaged product in said container.

6. An easy-open container as defined in claim 1, wherein said fibrous body wall layer comprises a helically-wound layer of paperboard, wherein said inner liner layer comprises a laminate of aluminum foil and paper, wherein said outer reinforcing layer comprises a helically-wound laminate of aluminum foil and paper, and wherein said reinforcing layer is secured to the fibrous body wall layer by an adhesive that is applied in the liquid state.

7. An easy-open container as defined in claim 1, wherein said outer reinforcing layer comprises a relatively-narrow peelable helical strip coextensive with and bridging said butt joint, said helical strip being secured to the outer surfaces of the edge portions of said fibrous body wall layer on both sides of sa said butt joint.

8. An easy-open container as recited in claim 1, wherein the outer wrapper layer comprises a helically-wound layer having a greater width than the fibrous body wall layer, whereby the leading edge of the outer reinforcing layer overlaps the trailing edge thereof, said outer reinforcing layer comprising a label having printed indicia thereon wound with a corresponding helical pitch about said fibrous body wall layer.

9. An easy-open container as recited in claim 8, wherein said outer reinforcing layer contains a circular scoreline adjacent and spaced from one end of the tubular body wall, thereby to define in said outer reinforcing layer a pull tab portion for initiating removal of the outer reinforcing layer.

* * * * *